US012442318B2

(12) United States Patent
Sheng et al.

(10) Patent No.: US 12,442,318 B2
(45) Date of Patent: Oct. 14, 2025

(54) CAM PHASE REGULATOR ASSEMBLY

(71) Applicant: Schaeffler Technologies AG & Co. KG, Herzogenaurach (DE)

(72) Inventors: Huifang Sheng, Suzhou (CN); Ting Quan, Shanghai (CN)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 18/844,049

(22) PCT Filed: Mar. 7, 2022

(86) PCT No.: PCT/CN2022/079588
§ 371 (c)(1),
(2) Date: Sep. 5, 2024

(87) PCT Pub. No.: WO2023/168566
PCT Pub. Date: Sep. 14, 2023

(65) Prior Publication Data

US 2025/0215815 A1 Jul. 3, 2025

(51) Int. Cl.
*F01L 1/344* (2006.01)

(52) U.S. Cl.
CPC ... *F01L 1/3442* (2013.01); *F01L 2001/34426* (2013.01)

(58) Field of Classification Search
CPC ..... F01L 1/3442; F01L 2001/34426
See application file for complete search history.

(56) References Cited

U.S. PATENT DOCUMENTS

| | | | | |
|---|---|---|---|---|
| 11,131,221 | B1 | 9/2021 | Burke | |
| 2017/0183987 | A1* | 6/2017 | Noguchi | F01L 1/3442 |
| 2017/0342870 | A1* | 11/2017 | Huerta Ortiz | F16K 15/044 |
| 2018/0058272 | A1 | 3/2018 | Haltiner, Jr. | |

FOREIGN PATENT DOCUMENTS

| | | | |
|---|---|---|---|
| CN | 101900005 | A | 12/2010 |
| CN | 204921086 | U | 12/2015 |
| CN | 109989797 | A | 7/2019 |
| CN | 111485969 | A | 8/2020 |
| CN | 115875100 | A | 3/2023 |

(Continued)

OTHER PUBLICATIONS

Author: LuMinxun, QianQiwei, XuBaofu, LiMengru Title: Functional testing of variable cam timing systems vol. 13 No. 5 Date: Oct. 2015.

*Primary Examiner* — Ngoc T Nguyen
(74) *Attorney, Agent, or Firm* — Matthew V. Evans

(57) ABSTRACT

The present disclosure relates to a cam phase regulator assembly. The cam phase regulator assembly includes a stator, a rotor, and an engine oil control valve. The rotor is rotatably mounted on the radial inner side of the stator, the engine oil control valve comprises a valve core and an elastic piece, and the valve core is mounted on the radial inner side of the rotor in a manner of being movable in the axial direction. The cam phase regulator assembly further includes a retaining plate mounted at an axial end of the rotor. A hydraulic flow channel leading to the rotor is provided on the retaining plate, and the elastic piece is abutted between the retaining plate and the valve core along the axial direction.

20 Claims, 6 Drawing Sheets

(56) References Cited

FOREIGN PATENT DOCUMENTS

| | | | |
|---|---|---|---|
| CN | 117072271 | A | 11/2023 |
| WO | 2023019599 | A1 | 2/2023 |
| WO | 2023024120 | A1 | 3/2023 |
| WO | 2023077527 | A1 | 5/2023 |
| WO | 2023077529 | A1 | 5/2023 |

* cited by examiner

CAM PHASE REGULATOR ASSEMBLY

CROSS-REFERENCE TO RELATED APPLICATIONS

This application is the U.S. National Phase of PCT Application No. PCT/CN2022/079588 filed on Mar. 7, 2022, the entire disclosure of which is incorporated by reference herein.

TECHNICAL FIELD

The present disclosure relates to the technical field of vehicles. In particular, the present disclosure relates to a cam phase regulator assembly for an engine timing system.

BACKGROUND

In order to obtain the optimal combustion efficiency of an internal combustion engine, it is usually necessary to change an intake air volume in a combustion chamber according to an operating state of the engine, and therefore, variable valve timing (VVT) technology emerges. A main component for implementing variable valve timing is a cam phase regulator. The cam phase regulator comprises a stator and a rotor that can rotate relative to each other, wherein the stator is connected to a sprocket wheel, and the rotor is connected to a camshaft. The cam phase regulator drives, by a hydraulic fluid, the rotor to rotate relative to the stator, thereby adjusting a phase of the camshaft. To control the flow of the hydraulic fluid into or out of a hydraulic cavity, an engine oil control valve is usually further mounted in the cam phase regulator.

As disclosed in patent documents such as CN 109989797 A, in the prior art, the engine oil control valve is an independent component assembled into the cam phase regulator. The engine oil control valve is generally inserted into the center of the rotor of the cam phase regulator, and one end of the engine oil control valve protrudes to the outside of the rotor and is interlinked with the camshaft by threads. The engine oil control valve comprises a cylindrical valve body, and other components of the engine oil control valve are all mounted inside the valve body. A one-way valve and a filter of the engine oil control valve are mounted at an oil inlet so as to control the one-way inflow of the hydraulic fluid and filter the incoming hydraulic fluid. A sleeve of the engine oil control valve diverts the hydraulic fluid and supports a spring. The spring provides an elastic restoring force for a valve core. By means of the movement of the valve core in the valve body, different flow channels in the rotor may be in communication, thereby controlling the hydraulic fluid to flow into and out of different hydraulic cavities.

In the prior art, for the rotor, the engine oil control valve and the camshaft, the mounting relationship among them is complicated, there is a large number of components, and production costs are high.

SUMMARY

Therefore, the technical problem to be solved by the present disclosure is to provide an improved cam phase regulator assembly.

The cam phase regulator assembly comprises a stator, a rotor, and an engine oil control valve, the rotor is rotatably mounted on the radial inner side of the stator, the engine oil control valve comprises a valve core and an elastic piece, and the valve core is mounted on the radial inner side of the rotor in a manner of being movable in the axial direction. The cam phase regulator assembly further comprises a retaining plate mounted at an axial end of the rotor, hydraulic flow channels leading to the rotor are provided on the retaining plate, and the elastic piece is abutted between the retaining plate and the valve core along the axial direction. The retaining plate mounted at the axial end of the rotor may close a central cavity of the rotor and provide axial support for the elastic piece of the engine oil control valve. This allows each component of the engine oil control valve to be mounted inside the rotor, without having to extend into a camshaft.

According to an example embodiment of the present disclosure, the cam phase regulator assembly may further comprise a one-way valve and/or a filter clamped between the rotor and the retaining plate. Thus, the one-way valve and/or the filter may be mounted in a simple way.

According to an example embodiment of the present disclosure, the one-way valve and/or the filter may have the same outer profile as the retaining plate. This allows the one-way valve and/or the filter to be directly clamped between the rotor and retaining plate, and ensures a good sealing effect.

According to an example embodiment of the present disclosure, the cam phase regulator assembly may further comprise a supporting pin and a timing pin which pass through both the rotor and the retaining plate along the axial direction, respectively. The supporting pin is configured to position a return spring of the rotor, and the timing pin is configured for the timing of the rotor. Relative positions of the retaining plate and the rotor in a plane perpendicular to the axial direction may be defined by these two pins.

According to an example embodiment of the present disclosure, one of the supporting pin and the timing pin may be tightly fitted with the retaining plate, and the other one may be loosely fitted with the retaining plate. In particular, before the cam phase regulator assembly is mounted into the engine, by one of the supporting pin and the timing pin, which is tightly fitted with the retaining plate, the retaining plate may be prevented from moving axially relative to the rotor, while avoiding increasing mounting difficulty.

According to an example embodiment of the present disclosure, the rotor may be configured to be fixedly connected to the camshaft by a bolt, the bolt is configured to pass through the rotor and the retaining plate along the axial direction and to be connected to the camshaft, thereby clamping the retaining plate between the camshaft and the rotor. After the cam phase regulator assembly is mounted into the engine, the retaining plate is positioned by the bolt.

According to an example embodiment of the present disclosure, the cam phase regulator assembly may further comprise a sprocket wheel fixed at an axial end of the stator, the sprocket wheel comprises a center hole for the camshaft to pass through and a flange protruding from an inner wall of the center hole towards a radial inner side, and the retaining plate is constrained between the flange and the rotor in the axial direction. In particular, before the cam phase regulator assembly is mounted into the engine, by the flange of the sprocket wheel, the retaining plate may be prevented from falling off.

According to an example embodiment of the present disclosure, an inner sidewall of the flange may be configured to guide and position the camshaft relative to the stator. Since the sprocket wheel is fixed onto the stator, and the rotor is fixed onto the camshaft, the flange helps guide the alignment of the camshaft and the rotor relative to the stator.

According to an example embodiment of the present disclosure, the retaining plate may comprise flow channel holes passing therethrough along the axial direction, and the flow channel holes are configured to introduce a hydraulic fluid from the camshaft into the engine oil control valve, thereby serving as hydraulic flow channels leading to the rotor. The hydraulic fluid from the camshaft may enter the engine oil control valve through the flow channel holes on the retaining plate, and then enter different hydraulic cavities between the stator and the rotor through hydraulic flow channels in the engine oil control valve and the rotor.

According to an example embodiment of the present disclosure, the hydraulic flow channels of the engine oil control valve may be integrally formed in the rotor, and an inner sidewall of the rotor guides the valve core. Thus, the structure of the engine oil control valve is further simplified.

BRIEF DESCRIPTION OF THE DRAWINGS

The present disclosure is further described below in conjunction with the accompanying drawings. The same reference numerals in the drawings will be used to refer to elements with the same functions. In the drawings.

DETAILED DESCRIPTION

The detailed description of a cam phase regulator assembly according to the present disclosure will be described below in conjunction with the accompanying drawings. The following detailed description and drawings are intended to exemplarily illustrate the principle of the present disclosure. The present disclosure is not limited to the described example embodiments.

According to example embodiments of the present disclosure, provided is a cam phase regulator assembly for an engine of a motor vehicle. Such cam regulator assembly may be connected to a camshaft configured to control an engine valve, so as to adjust a phase of the cam.

Figure 1:
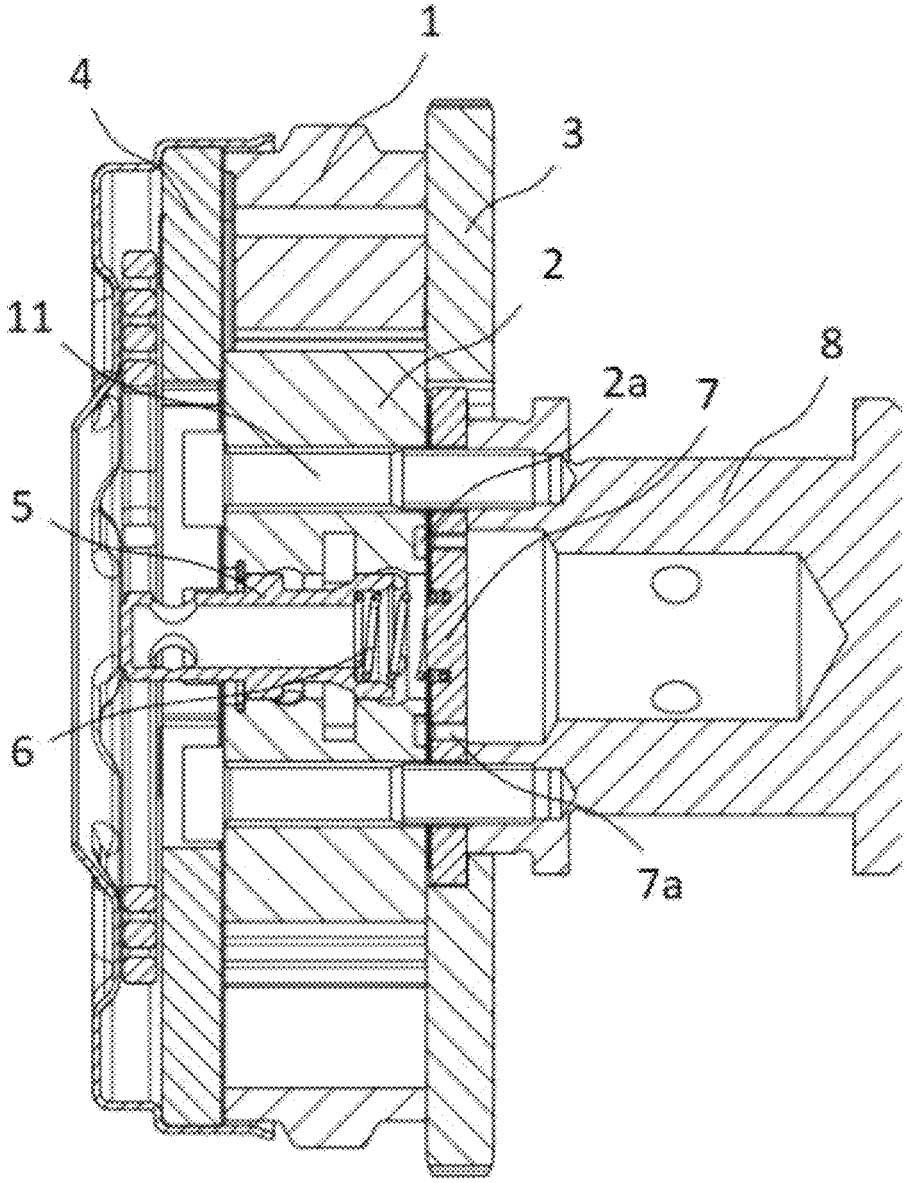
FIG. 1 shows a cross-sectional view of a cam phase regulator assembly according to an exemplary embodiment of the present disclosure.
Figure 2A:
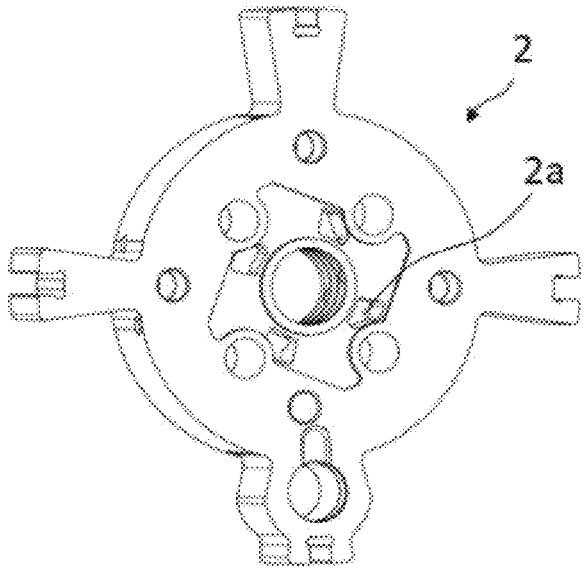
FIGS. 2*a* to 2*e* show schematic diagrams of components of a cam phase regulator assembly according to an exemplary embodiment of the present disclosure, respectively.

FIG. 1 shows a cross-sectional view of a cam phase regulator assembly according to an example embodiment of the present disclosure. As shown in FIG. 1, the cam phase regulator assembly mainly comprises a stator 1, a rotor 2, a sprocket wheel 3, an end cover 4, an engine oil control valve, etc. The stator 1 as a whole is in an approximately cylindrical shape and has a plurality of webs protruding inwards from a main body portion along the radial direction, and these webs are distributed at intervals along the circumferential direction. As shown in FIG. 2*a*, the rotor 2 as a whole is in an approximately cylindrical shape and has a plurality of blades protruding outwards from a main body portion along the radial direction. The rotor 2 is coaxially mounted on the radial inner side of the stator 1 and can rotate relative to the stator 1 approximately about a central axis of the cam phase regulator assembly (see FIG. 3*c*). The number of webs of the stator 1 is the same as the number of blades of the rotor 2. When the rotor 2 is mounted into the stator 1, the webs and the blades are alternately distributed in the circumferential direction, each web abuts against the main body portion of the rotor 2, and each blade abuts against the main body portion of the stator 1. Therefore, a hydraulic cavity is formed between each pair of adjacent web and blade, and these hydraulic cavities are in communication with the engine oil control valve by corresponding hydraulic channels, respectively.

Figure 3A:
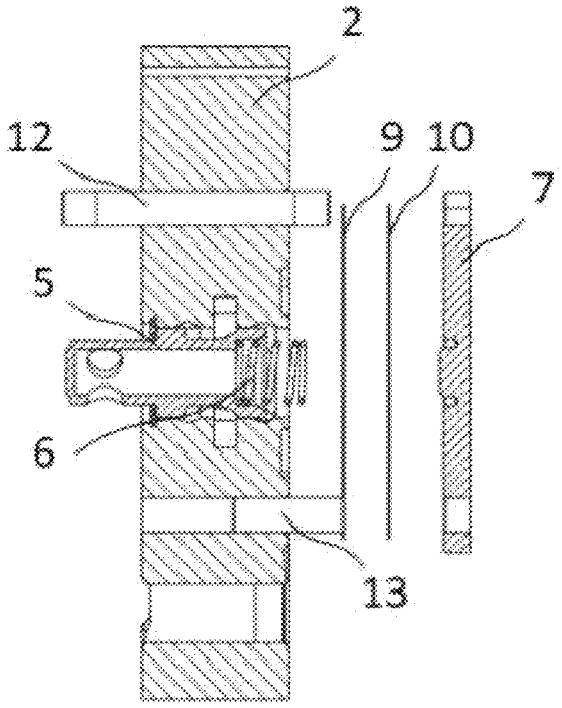
FIGS. 3*a* to 3*e* show schematic diagrams of assembly processes of a cam phase regulator assembly according to an exemplary embodiment of the present disclosure, respectively.
Figure 3B:
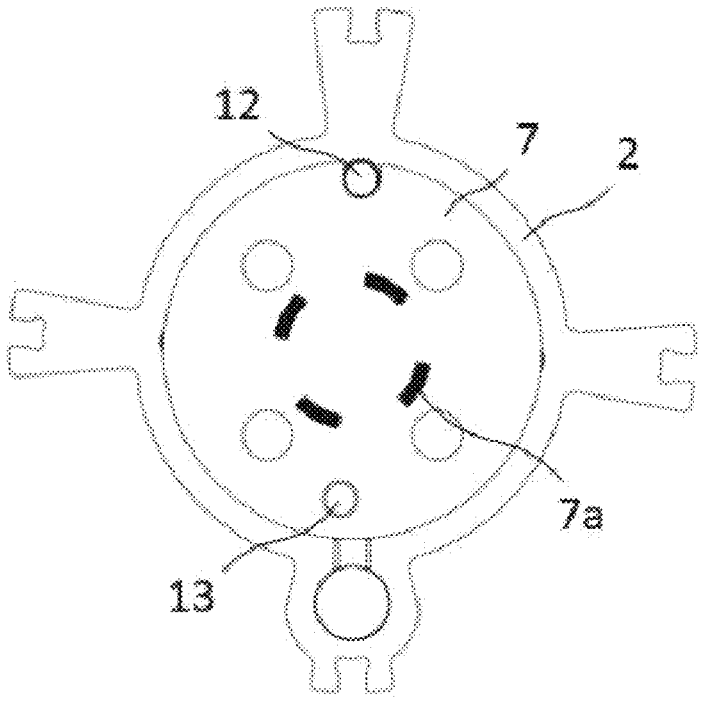
Figure 3C:
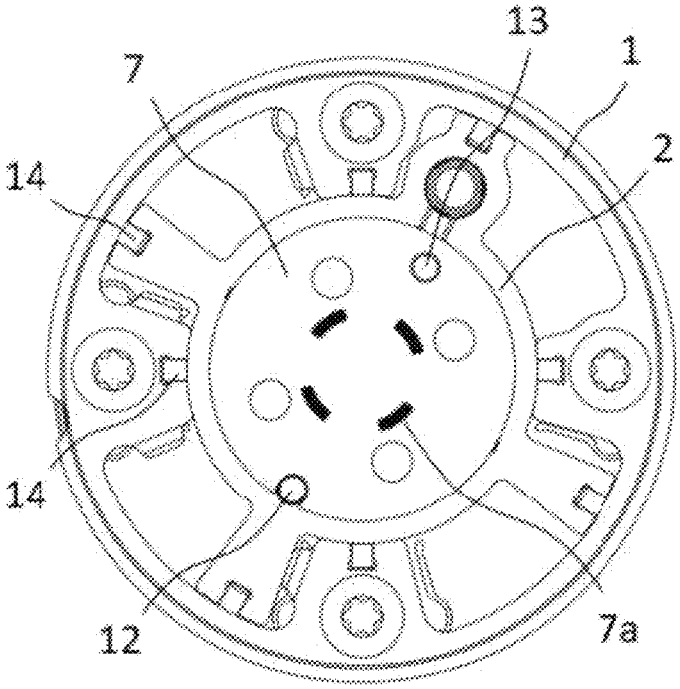

As shown in FIG. 3*c*, an elastic seal 14 may be provided at an end of each web and/or blade. The seal 14 is compressed between the web and the main body portion of the rotor 2 and/or between the blade and the main body portion of the stator 1 along the radial direction, thereby relatively sealing two hydraulic cavities which are adjacent to each other along the circumferential direction. Furthermore, these seals 14 may further compensate for radial misalignment between the stator 1 and the rotor 2 by elastic deformation.

The sprocket wheel 3 and the end cover 4 are fixed at two ends of the stator 1, respectively, thereby being opposed to each other along the axial direction. The sprocket wheel 3 and the end cover 4 abut against the rotor 2 in opposite directions from two axial ends, respectively, thereby defining an axial position of the rotor 2 relative to the stator 1. In addition, the sprocket wheel 3 and the end cover 4 close the hydraulic cavities between the webs and the blades from the two axial ends, respectively. The sprocket wheel 3 may be engaged with a chain or a belt to drive the stator 1 to rotate.

The engine oil control valve is mounted on the radial inner side of the rotor 2, particularly being coaxially mounted at a center of the rotor 2. The engine oil control valve may control the flow of a hydraulic fluid into and out of the hydraulic cavities between the webs and the blades, thereby controlling a rotation position of the rotor 2 relative to the stator 1. The engine oil control valve comprises a valve core 5 and an elastic piece 6. The valve core 5 is mounted on the radial inner side of the rotor 2 in a manner of being movable in the axial direction. In the present embodiment, the engine oil control valve does not have an independent valve body, hydraulic flow channels of the engine oil control valve are integrated in the rotor 2, and the valve core 5 is in direct contact with an inner sidewall of the rotor 2 and can move along a center hole of the rotor 2 in the axial direction. However, the engine oil control valve may also alternatively have components such as an independent valve body, and have channels, which cooperate with the hydraulic flow channels in the rotor 2, in the valve body. On the basis of an axial position of the valve core 5, the engine oil control valve may be in communication with hydraulic cavities between different webs and blades.

Figure 2B:
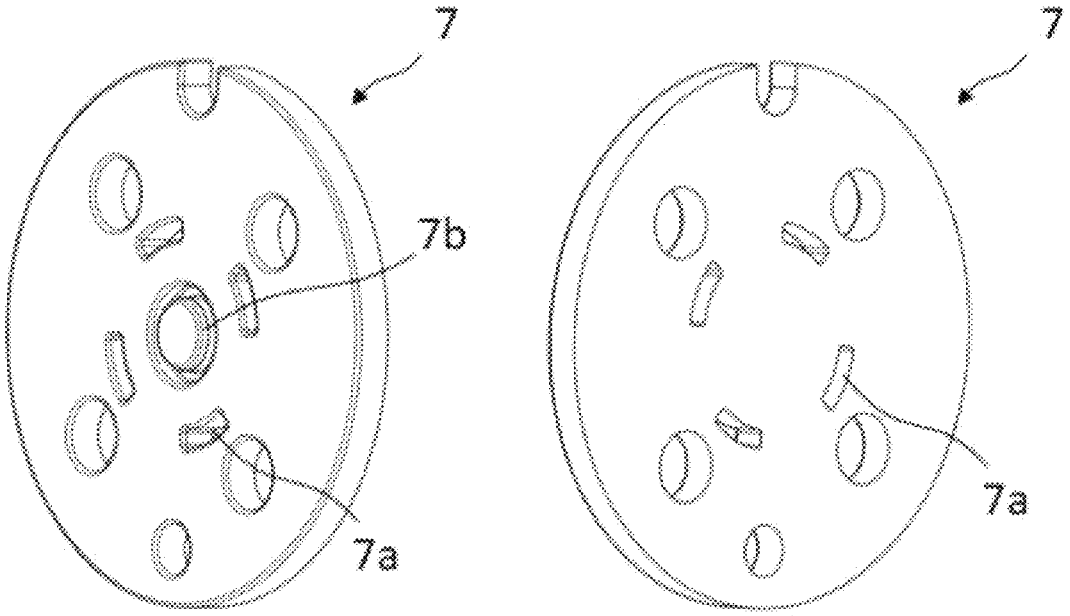

The cam phase regulator assembly further comprises a retaining plate 7 mounted at an axial end of the rotor 2. As shown in FIG. 2*b*, the retaining plate 7 is a substantially disc-shaped component. An outer diameter of the retaining plate 7 is less than an outer diameter of the circular main body portion of the rotor 2. As shown in FIG. 1, the retaining plate 7 is mounted at one end of the rotor 2 facing the camshaft 8 and closes a center hole in which the valve core 5 is mounted. The retaining plate 7 is formed with a plurality of flow channel holes 7*a* distributed at intervals along the circumferential direction. Each flow channel hole 7*a* passes through the retaining plate 7 along the axial direction and is aligned with a corresponding flow channel port 2*a* in the rotor 2 (which, in other embodiments, may also be a valve body). The hydraulic fluid may enter the flow channel ports 2*a* via the flow channel holes 7*a*, and then enter the engine oil control valve.

The elastic piece 6 is abutted between the retaining plate 7 and the valve core 5 along the axial direction, thereby applying, to the valve core 5, an elastic force that is axially away from the retaining plate 7. The valve core 5 moves in the center hole along the axial direction under the action of both the elastic force of the elastic piece 6 and liquid pressure. In the present embodiment, the elastic piece 6 is, for example, a coil spring. However, in other embodiments, the elastic piece 6 may also be other elastic components. As shown in the left panel in FIG. 2*b*, a slot 7*b* may be formed on one side of the retaining plate 7 facing the rotor 2, and an end of the elastic piece 6 may be accommodated in the slot 76. The slot 7*b* may constrain a position of the elastic piece 6 in the radial direction.

As shown in FIG. 1, the rotor 2 is fixedly connected to the camshaft 8 by at least one, or a plurality of bolts 11. When the cam phase regulator assembly is mounted on the camshaft 8, an end of the camshaft 8 abuts against one side of the retaining plate 7 away from the rotor 2, and each bolt 11 passes through the rotor 2 and the retaining plate 7 along the axial direction and is connected to the end of the camshaft 8. The retaining plate 7 is thus clamped between the rotor 2 and the camshaft 8. In this case, the rotor 2, the retaining plate 7 and the camshaft 8 are fixedly connected to one another by the bolts 11. In order to mount the bolts 11, bolt holes corresponding to one another are formed on the rotor 2, the retaining plate 7 and the camshaft 8, respectively.

The end of the camshaft 8 is formed with a cavity. When the cam phase regulator assembly is connected to the camshaft 8, the cavity of the camshaft 8 can be in communication with the plurality of flow channel holes 7*a* of the retaining plate 7, thereby supplying the hydraulic fluid to the engine oil control valve.

Figure 2C:
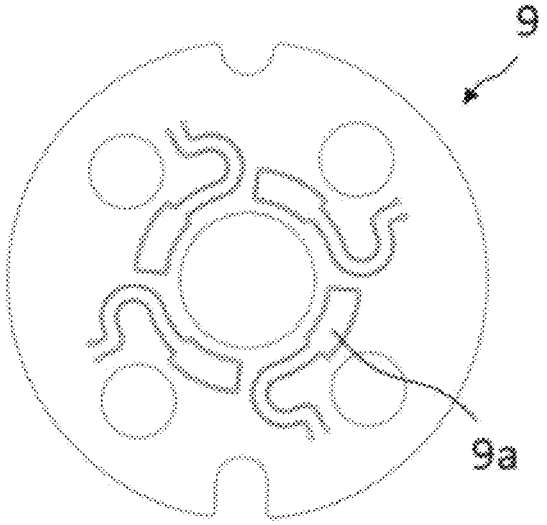

The cam phase regulator assembly further comprises a one-way valve 9. As shown in FIG. 2*c*, the one-way valve 9 is formed as a sheet-like component, and is clamped between the retaining plate 7 and the rotor 2. The one-way valve 9 comprises a plurality of valve plates 9*a* that can elastically move to open or close openings, and these valve plates 9*a* are distributed at intervals along the circumferential direction. The number of valve plates 9*a* is equal to the number of flow channel holes 7*a* on the retaining plate 7, and each valve plate 9*a* is aligned with a corresponding flow channel hole 7*a* on the retaining plate 7 and a corresponding flow channel port 2*a* on the rotor 2 (which, in other embodiments, may also be a valve body) along the axial direction. The valve plates 9*a* can only be opened towards one side of the rotor 2 under the action of a hydraulic differential pressure, thereby allowing only the one-way flow of the hydraulic fluid into the engine oil control valve. The one-way valve 9 as a whole may have substantially the same outer profile as the retaining plate 7, such that the one-way valve 9 may be firmly clamped between the retaining plate 7 and the rotor 2. In this case, the bolts 11 also pass through bolt holes on the one-way valve 9. The one-way valve 9 may have a center hole, such that the elastic piece 6 may pass through the center hole to directly abut against the retaining plate 7.

Figure 2D:
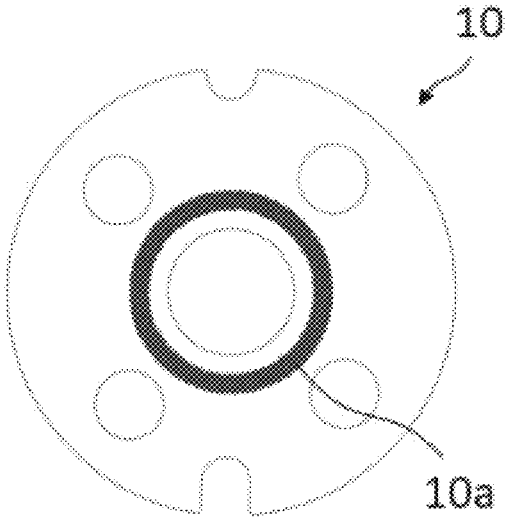

The cam phase regulator assembly may further additionally comprise a filter 10. As shown in FIG. 3*a*, the filter 10 is clamped between the retaining plate 7 and the rotor 2, and particularly may be clamped, together with the one-way valve 9, between the retaining plate 7 and the rotor 2. The filter 10 is located between the one-way valve 9 and the retaining plate 7, thereby avoiding hindering the valve plates 9*a* from being opened towards the rotor 2. As shown in FIG. 2*d*, the filter 10 may be formed as a sheet-like component comprising a filter mesh portion 10*a*. In a projection perpendicular to the axial direction, the filter mesh portion 10*a* covers at least a region corresponding to the flow channel holes 7*a*. The hydraulic fluid flowing from the flow channel holes 7*a* to the flow channel ports 2*a* is first filtered by the filter mesh portion 10*a*, thereby reducing or removing impurities. As shown in FIG. 2*d*, the filter mesh portion 10*a* may be formed as an annular section. Similar to the one-way valve 9, the filter 10 as a whole may also have substantially the same outer profile as the retaining plate 7. In this case, the bolts 11 also pass through bolt holes on the filter 10. The filter 10 may also have a center hole, such that the elastic piece 6 may pass through the center hole to directly abut against the retaining plate 7.

As shown in FIGS. 3*a* and 3*b*, the cam phase regulator assembly further comprises a supporting pin 12 and a timing pin 13. The supporting pin 12 is configured to support and position a return spring of the rotor 2, and the timing pin 13 is configured for the timing of the rotor 2. The supporting pin 12 and the timing pin 13 are each formed as a substantially cylindrical component. Ends of the supporting pin 12 and the timing pin 13 facing the camshaft 8 may pass through both the rotor 2 and the retaining plate 7 along the axial direction, respectively. Thus, even when no bolt 11 is mounted, the retaining plate 7 can be positioned, by the supporting pin 12 and the timing pin 13, relative to the rotor 2 in a plane perpendicular to the axial direction. As stated above, when the cam phase regulator assembly comprises the one-way valve 9 and the filter 10, which have substantially the same outer profile as the retaining plate 7, respectively, the supporting pin 12 and the timing pin 13 also pass through both the one-way valve 9 and the filter 10, respectively.

One of the supporting pin 12 and the timing pin 13 may be tightly fitted with the retaining plate 7, and the other one may be loosely fitted with the retaining plate 7. The one that is tightly fitted with the retaining plate 7 may provide a certain axial constraint force for the retaining plate 7, thereby reducing the risk of the retaining plate 7 falling off the rotor 2 during mounting process. The one that is loosely fitted with the retaining plate 7 may reduce requirement for accuracy of fit. As shown in FIG. 3*b*, in the present embodiment, since the position of the supporting pin 12 is closer to the radial outer side, a mounting hole, used for the supporting pin 12, of the retaining plate 7 has a notch, whereas the position of the timing pin 13 is closer to the radial inner side, such that a mounting hole, used for the timing pin 13, of the retaining plate 7 is a complete hole. In this case, the supporting pin 12 can be loosely fitted with the retaining plate 7, and the timing pin 13 can be tightly fitted with the retaining plate 7. However, in other embodiments, alternatively, the timing pin 13 may also be loosely fitted with the retaining plate 7, and the supporting pin 12 may be tightly fitted with the retaining plate 7.

Figure 2E:
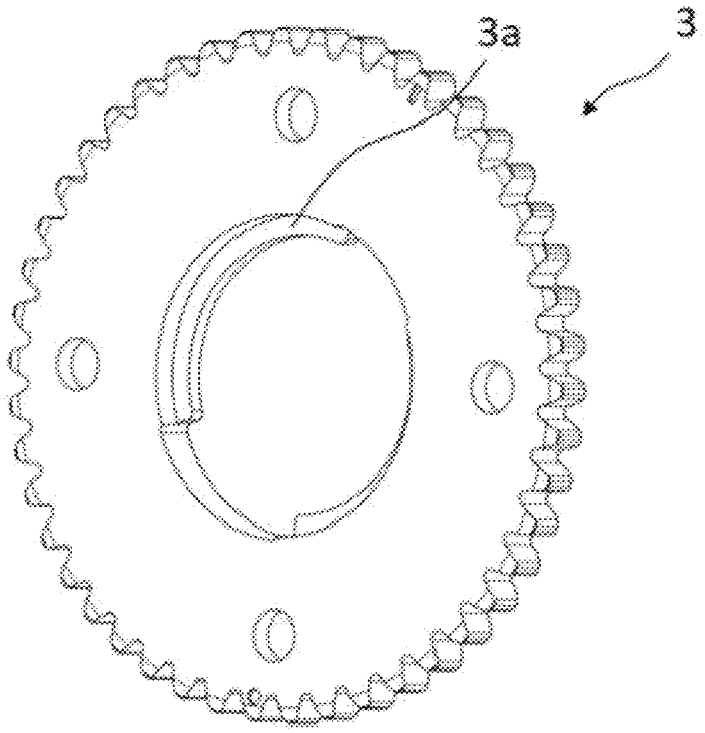
Figure 3D:
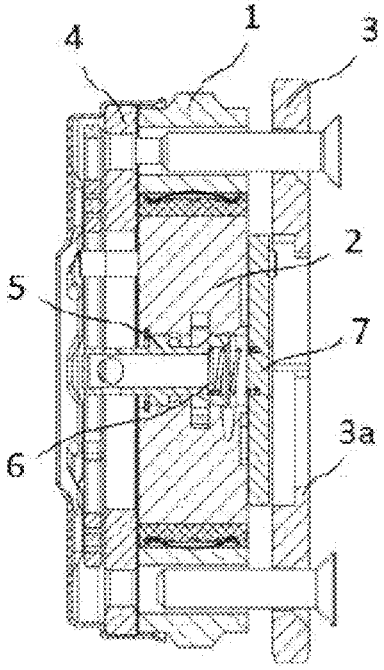

FIG. 2*e* shows a perspective view of the sprocket wheel 3. As shown in FIG. 2*e*, the sprocket wheel 3 is a substantially disc-shaped component. As shown in FIG. 3*d*, the sprocket wheel 3 is coaxially fixed (for example, via bolts or other fasteners, or by means of welding or other methods) to one end of the stator 1 facing the camshaft 8, and is coaxially arranged with the rotor 2. The outer periphery of the sprocket wheel 3 is formed with teeth for being engaged with a chain, and the chain can drive the stator 1 by the sprocket wheel 3. A center hole is formed on the radial inner side of the sprocket wheel 3, an outer diameter of the center hole is greater than an outer diameter of the camshaft 8, and the camshaft 8 can pass through the center hole of the sprocket wheel 3, so as to abut against the retaining plate 7. The outer diameter of the center hole is also greater than the outer diameter of the retaining plate 7, such that the retaining plate 7 can be accommodated on the radial inner side of the sprocket wheel 3. The sprocket wheel 3 may comprise a flange 3*a* protruding from an inner wall of the center hole towards the radial inner side. In an example embodiment, the flange 3*a* is axially located on one side, which is away from the rotor 2, of the retaining plate 7, and is not in contact with the retaining plate 7. In addition, the flange 3*a* inwardly crosses over the outer profile of the retaining plate 7 in the radial direction, and the retaining plate 7 may thus be constrained between the flange 3*a* and the rotor 2 in the axial direction. As shown in the right panel in FIG. 3*e*, this prevents the retaining plate 7 from falling off even when the cam phase regulator assembly is not connected to the camshaft 8.

Figure 3E:
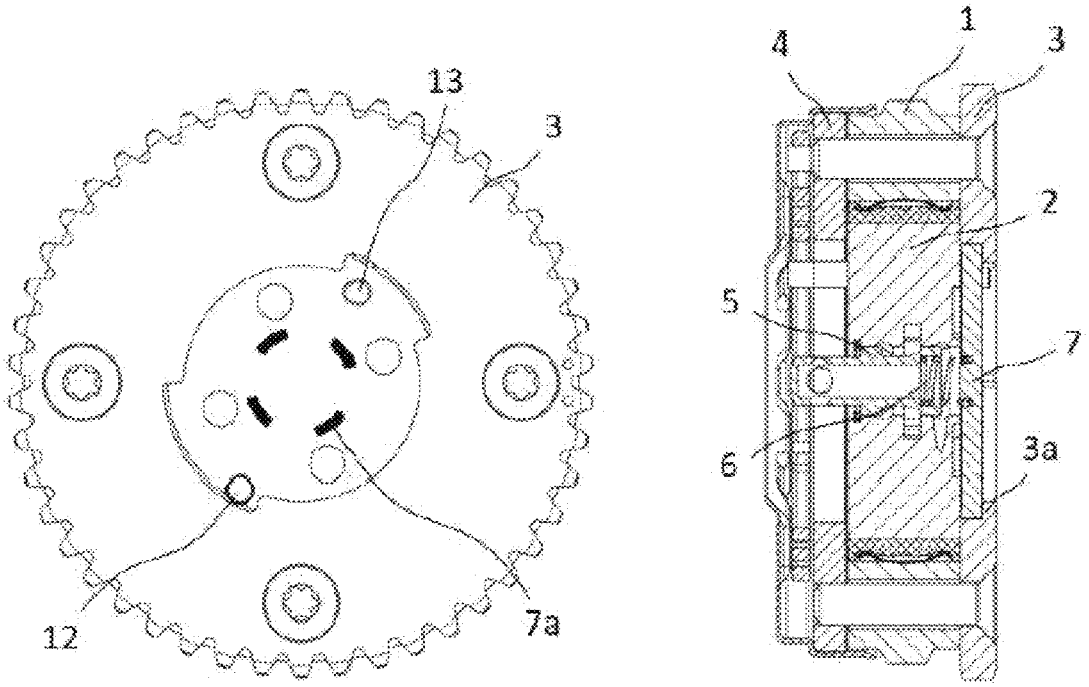

The flange 3*a* may be a complete annular flange and may also be a flange having notches in the circumferential direction. As shown in FIG. 3*e*, in the present embodiment, the flange 3*a* has two notch portions in the circumferential direction, so as to avoid interference with the supporting pin 12 and the timing pin 13. However, when the supporting pin 12 and the timing pin 13 do not interfere with the flange 3*a* (for example, due to changes in positions or lengths of the supporting pin 12 and the timing pin 13, or due to changes in the size of the flange 3*a*), the flange 3*a* may also be formed as a complete annular flange.

As shown in FIG. 1, the flange 3*a* may have an inner sidewall extending along the circumferential direction, and an outer diameter of the inner sidewall corresponds to (slightly greater than) an outer diameter of the end of the camshaft 8. The inner sidewall of the flange 3*a* can be in contact with an outer sidewall of the camshaft 8 without hindering the rotation of the camshaft 8 relative to the stator 1, so as to guide and position the camshaft 8, such that a central axis of the camshaft 8 can be substantially aligned with a central axis of the stator 1. Thus, a central axis of the rotor 2 fixedly connected to the camshaft 8 can also be substantially aligned with the central axis of the stator 1. Thus, the stator 1, the rotor 2 and the camshaft 8 can rotate about a common central axis.

The cam phase regulator assembly according to the present disclosure improves a connection mode among the rotor, the engine oil control valve, and the camshaft. The retaining plate closes the engine oil control valve and provides support for the elastic piece, such that the camshaft may directly abut against the retaining plate, the engine oil control valve does not need to be inserted into the camshaft, and the camshaft does not need to be inserted into the rotor, either. The retaining plate has a relatively simple function and structure, is easy to manufacture, and has low production costs. In the process of fastening the retaining plate, components such as the one-way valve and the filter may also be directly fixed onto the rotor, making the mounting process more convenient and reliable. Furthermore, the sprocket wheel may further be used to provide guidance and positioning functions for the camshaft to facilitate alignment between the camshaft and the stator. Since the camshaft, the rotor and the retaining plate are directly fixed together, the camshaft and the rotor do not need to be aligned via the retaining plate, and therefore, the requirement for assembly accuracy is low, which is conducive to further reducing the production costs.

Although possible embodiments have been described illustratively in the above description, it should be understood that there are still a large number of embodiment variations through combinations of all known technical features and embodiments as well as those that are readily apparent to those skilled in the art. In addition, it should be further understood that the exemplary embodiments are just examples and shall not in any way limit the scope of protection, application and construction of the present disclosure. The foregoing description is more intended to provide those skilled in the art with a technical guidance for converting at least one exemplary embodiment, in which various changes, especially changes in the functions and structures of the components, can be made as long as they do not depart from the scope of protection of the claims.

LIST OF REFERENCE NUMERALS

1 Stator
2 Rotor
2*a* Flow channel port
3 Sprocket wheel
3*a* Flange
4 End cover
5 Valve core
6 Elastic piece
7 Retaining plate
7*a* Flow channel hole
7*b* Slot
8 Camshaft
9 One-way valve
9*a* Valve plate
10 Filter
10*a* Filter mesh portion
11 Bolt
12 Supporting pin
13 Timing pin
14 Seal

The invention claimed is:

1. A cam phase regulator assembly, comprising:
a stator,
a rotor rotatably mounted on a radial inner side of the stator, and
an engine oil control valve comprising:
a valve core mounted on a radial inner side of the rotor so as to be movable in an axial direction, and
an elastic piece, and
a retaining plate mounted at an axial end of the rotor, the retaining plate having hydraulic flow channels leading to the rotor, and
the elastic piece is abutted between the retaining plate and the valve core along the axial direction.

2. The cam phase regulator assembly according to claim 1, further comprising a one-way valve and/or a filter clamped between the rotor and the retaining plate.

3. The cam phase regulator assembly according to claim 2, wherein the one-way valve and/or the filter have a same outer profile as the retaining plate.

4. The cam phase regulator assembly according to claim 2, wherein hydraulic flow channels of the engine oil control valve are integrally formed in the rotor, and an inner sidewall of the rotor guides the valve core.

5. The cam phase regulator assembly according to claim 1, wherein the cam phase regulator assembly further comprises a supporting pin and a timing pin which pass through both the rotor and the retaining plate along the axial direction, respectively.

6. The cam phase regulator assembly according to claim 5, wherein one of the supporting pin and the timing pin is tightly fitted with the retaining plate, and a remaining one of the supporting pin and the timing pin is loosely fitted with the retaining plate.

7. The cam phase regulator assembly according to claim 1, wherein the rotor is configured to be fixedly connected to a camshaft by a bolt, and the bolt is configured to pass through the rotor and the retaining plate along the axial direction and to be connected to the camshaft, thereby clamping the retaining plate between the camshaft and the rotor.

8. The cam phase regulator assembly according to claim 7, wherein the cam phase regulator assembly further comprises:

a sprocket wheel fixed at an axial end of the stator, the sprocket wheel having a center hole configured for the camshaft to pass through and a flange protruding from an inner wall of the center hole, and the retaining plate is constrained between the flange and the rotor in the axial direction.

9. The cam phase regulator assembly according to claim 8, wherein an inner sidewall of the flange is configured to guide and position the camshaft relative to the stator.

10. The cam phase regulator assembly according to claim 7, wherein the retaining plate comprises flow channel holes passing therethrough along the axial direction, and the flow channel holes are configured to introduce a hydraulic fluid from the camshaft into the engine oil control valve.

11. A cam phase regulator assembly, comprising:

a stator, a rotor rotatably mounted on a radial inner side of the stator, and an engine oil control valve comprising:

a valve core mounted on a radial inner side of the rotor so as to be movable in an axial direction, and an elastic piece, and a retaining plate mounted at an axial end of the rotor, the retaining plate having hydraulic flow channels extending therethrough, the hydraulic flow channels configured to fluidly connect a camshaft to the engine oil control valve, and the elastic piece is abutted between the retaining plate and the valve core along the axial direction.

12. The cam phase regulator assembly according to claim 11, further comprising a filter disposed between the retaining plate and the rotor in the axial direction.

13. The cam phase regulator assembly according to claim 12, further comprising a one-way valve disposed between the filter and the rotor.

14. The cam phase regulator assembly according to claim 13, wherein the elastic piece passes through the filter and the one-way valve.

15. The cam phase regulator assembly according to claim 14, further comprising bolts configured to attach the rotor and the retaining plate to the camshaft, the bolts configured to pass through the filter and the one-way valve.

16. The cam phase regulator assembly according to claim 11, further comprising a sprocket wheel configured to close hydraulic cavities formed between the rotor and the stator, and the retaining plate is disposed within a center hole of the sprocket wheel.

17. A cam phase regulator assembly, comprising:

a stator, a rotor rotatably mounted on a radial inner side of the stator so that hydraulic cavities are formed between the rotor and the stator, an engine oil control valve mounted inside of the rotor and fluidly connected to the hydraulic cavities, and a retaining plate mounted at an axial end of the rotor, the retaining plate: i) having hydraulic flow channels configured to fluidly connect a camshaft to the engine oil control valve, and ii) configured to close an end of the engine oil control valve, and an end cover fixed to a first end of the stator, a sprocket wheel fixed to a second end of the stator, the sprocket wheel and the end cover configured to close the hydraulic cavities formed between the rotor and the stator, and the retaining plate is disposed within the sprocket wheel.

18. The cam phase regulator assembly according to claim 17, wherein the retaining plate is axially clamped between the camshaft and the rotor.

19. The cam phase regulator assembly according to claim 18, further comprising a one-way valve, the one-way valve axially clamped between the rotor and the retaining plate.

20. The cam phase regulator assembly according to claim 19, wherein the one-way valve comprises a plurality of elastic valve plates configured to elastically move to open or close openings.

* * * * *